United States Patent [19]

Beck

[11] Patent Number: 4,595,060

[45] Date of Patent: Jun. 17, 1986

[54] DOWNHOLE TOOL WITH COMPRESSIBLE WELL FLUID CHAMBER

[75] Inventor: Harold K. Beck, Duncan, Okla.

[73] Assignee: Halliburton Company, Duncan, Okla.

[21] Appl. No.: 676,022

[22] Filed: Nov. 28, 1984

[51] Int. Cl.[4] ..... E21B 34/06

[52] U.S. Cl. ..... 166/373; 166/321; 166/324

[58] Field of Search ..... 166/373, 374, 319, 324, 166/332, 321, 334

[56] References Cited

U.S. PATENT DOCUMENTS

| | | | |
|---|---|---|---|
| Re. 29,562 | 3/1978 | Wray et al. | 166/164 |
| 3,664,415 | 5/1972 | Wray et al. | 166/264 |
| 3,782,461 | 1/1974 | Watkins | 166/72 |
| 3,856,085 | 12/1974 | Holden et al. | 166/264 |
| 3,858,649 | 1/1975 | Wray et al. | 166/162 |
| 3,860,069 | 1/1975 | Wray et al. | 166/264 |
| 3,915,228 | 10/1975 | Giebeler . | |
| 3,964,306 | 6/1976 | Wray et al. | 73/151 |
| 3,964,544 | 6/1976 | Farley et al. | 166/315 |
| 3,976,136 | 8/1976 | Farley et al. | 166/264 |
| 4,047,564 | 9/1977 | Nix et al. | 166/72 |
| 4,059,153 | 11/1977 | Nix et al. | 166/264 |
| 4,063,593 | 12/1977 | Jessup | 166/317 |
| 4,076,077 | 2/1978 | Nix et al. | 166/315 |
| 4,109,724 | 8/1978 | Barrington | 166/315 |
| 4,109,725 | 8/1978 | Williamson et al. | 166/315 |
| 4,113,012 | 9/1978 | Evans et al. | 166/264 |
| 4,125,165 | 11/1978 | Helmus | 166/323 |
| 4,144,937 | 3/1979 | Jackson et al. | 166/314 |
| 4,341,266 | 7/1982 | Craig | 166/317 |
| 4,422,506 | 12/1983 | Beck | 166/324 |
| 4,429,748 | 1/1984 | Beck | 166/324 |
| 4,444,268 | 4/1984 | Barrington | 166/373 |
| 4,448,254 | 5/1984 | Barrington | 166/373 |

*Primary Examiner*—Stephen J. Novosad
*Assistant Examiner*—Bruce M. Kisliuk
*Attorney, Agent, or Firm*—James R. Duzan; Lucian W. Beavers

[57] ABSTRACT

A downhole tool apparatus has a housing with a compression chamber defined therein. A fill passage is disposed through the housing for placing the compression chamber in open flow fluid communication with a well annulus exterior of the housing so that well fluid may flow into the compression chamber as the apparatus is lowered into a well. An isolation valve is provided for selectively closing the fill passage and thereby trapping well fluid in the compression chamber. An operating element is disposed in the housing. An actuating piston is slidably disposed in the housing and is operably associated with the operating element for operating the same in response to movement of the actuating piston relative to the housing. The actuating piston and housing are so arranged and constructed that movement of the actuating piston relative to the housing changes the volume of the compression chamber and of any well fluid trapped therein. The volume of the compression chamber is sufficiently large that an equal volume of water containing no absorbed gases would have a volume decrease when subjected to a pressure increase equivalent to a predetermined operating pressure of the actuating piston means, at least as great as the decrease in volume of the compression chamber when the actuating piston is moved between first and second positions thereof relative to the housing.

11 Claims, 10 Drawing Figures

DOWNHOLE TOOL WITH COMPRESSIBLE WELL FLUID CHAMBER

BACKGROUND OF THE INVENTION

1. Field of the Invention

The present invention relates generally to downhole tools, and particularly relates to tools utilizing a compression chamber within which is trapped a compressible fluid to act as a compressible fluid spring to help restore an actuating piston to an original position thereof.

2. Description of the Prior Art

It is well known in the art that downhole tools such as testing valves, circulating valves and samplers can be operated by varying the pressure of fluid in a well annulus and applying that pressure to a differential pressure piston within the tool.

The predominant method of creating the differential pressure across the differential pressure piston has been to isolate a volume of fluid within the tool at a fixed reference pressure. Such a fixed reference pressure has been provided in any number of ways.

Additionally, these prior art tools have often provided a volume of fluid, either liquid or gas, through which this reference pressure is transmitted. Sometimes this volume of fluid provides a compressible fluid spring which initially stores energy when the differential area piston compresses that fluid, and which then aids in returning the differential area piston to its initial position.

One manner of providing a fixed reference pressure is by providing an essentially empty sealed chamber on the low pressure side of the power piston, which chamber is merely filled with air at the ambient pressure at which the tool was assembled. Such a device is shown, for example, in U.S. Pat. No. 4,076,077 to Nix et al. with regard to its sealed chamber 42. This type of device does not balance hydrostatic annulus pressure across the power piston as the tool is run into the well. This device does not provide a fluid spring to aid in return of the power piston.

Another approach has been to provide a chamber on the low pressure side of the piston, and fill that chamber with a charge of inert gas such as nitrogen. Then, when the annulus pressure overcomes the gas pressure, the power piston is moved by that pressure differential, and the gas compresses to allow the movement of the power piston. Such a device is shown, for example, in U.S. Pat. No. 3,664,415 to Wray et al. with regard to its nitrogen cavity 44. This type of device does not balance hydrostatic annulus pressure across the power piston as the tool is run into the well. The Wray et al. device utilizes the compressed nitrogen gas in cavity 44 to bias the piston 42 thereof downwardly.

Another approach has been to use a charge of inert gas as described above, in combination with a supplementing means for supplementing the gas pressure with the hydrostatic pressure of the fluid in the annulus contained between the well bore and the test string, as the test string is lowered into the well. Such a device is shown, for example, in U.S. Pat. No. 3,856,085 to Holden et al. When a tool of this type has been lowered to the desired position in the well, the inert gas pressure is supplemented by the amount of the hydrostatic pressure in the well at that depth. Then, an isolation valve is closed which then traps in the tool a volume of well annulus fluid at a pressure substantially equal to the hydrostatic pressure in the well annulus at that depth. Once the isolation valve has closed, the reference pressure provided by the inert gas is no longer effected by further increases in well annulus pressure. Then, well annulus pressure may be increased to create a pressure differential across the power piston to actuate the tool. The Holden et al. device utilizes the energy stored in compression of the nitrogen gas within chamber 128 to assist in returning the power piston 124 to its upper position.

Also, rather than utilize a compressible inert gas such as nitrogen within such tools, it has been proposed to use a large volume of a somewhat compressible liquid such as silicone oil as a compressible fluid spring on the low pressure side of the tool. Such a device is seen, for example, in U.S. Pat. No. 4,109,724 to Barrington.

Other devices utilizing a large volume of trapped silicone oil as a compressible fluid spring are shown in U.S. Pat. Nos. 4,444,268 and 4,448,254 to Barrington. In each of these devices, the silicone oil pressure is supplemented by well annulus pressure as the tool is lowered into the well.

One recent device which has not relied upon either a large volume of compressible liquid or a volume of compressible gas is shown in U.S. Pat. No. 4,341,266 to Craig. This is a trapped reference pressure device which uses a system of floating pistons and a differential pressure valve to accomplish actuation of the tool. The reference pressure is trapped by a valve which shuts upon the initial pressurizing up of the well annulus after the packer is set. The Craig tool does balance hydrostatic pressure across its various differential pressure components as it is run into the well. The power piston 35 of the Craig device is returned to its original position by a mechanical coil compression spring 36 without the aid of any compressed volume of fluid.

Another relatively recent development is shown in U.S. Pat. No. 4,113,012 to Evans et al. This device utilizes fluid flow restrictors 119 and 121 to create a time delay in any communication of changes in well annulus pressure to the lower side of its power piston. During this time delay, the power piston moves from a first position to a second position. The particular tool disclosed by Evans et al. utilizes a compressed nitrogen gas chamber in combination with a floating shoe which transmits the pressure from the compressed nitrogen gas to a relatively non-compressible liquid filled chamber. This liquid filled chamber is communicated with the well annulus through pressurizing and depressurizing passages, each of which includes one of the fluid flow restrictors plus a back pressure check valve. Hydrostatic pressure is balanced across the power piston as the tool is run into the well, except for the relatively small differential created by the back pressure check valve in the pressurizing passage.

It is apparent from the numerous examples set forth above that it is well known in the prior art to create a trapped reference pressure within a tool by communicating a chamber within the tool with the well annulus, and then isolating that chamber to trap the reference pressure within the tool. In combination with that concept, a number of these prior tools have also utilized a volume of compressible inert gas or of a relatively compressible liquid such as silicone oil contained within the tool to act as a fluid spring to aid in returning the power piston to its initial position. This compressed gas or silicone oil generally is separated from the trapped well fluid providing the reference pressure by a floating piston so that the trapped well fluid and the compressed gas or silicone oil are always at the same pressure.

Those ones of the various prior art devices discussed above which do utilize a compressible fluid spring to aid in returning the power piston to its original position rely upon the compressibility of the compressed inert gas or silicone oil, and not upon compressibility of the well fluid itself which may be trapped within the tool.

Those tools utilizing either inert gas or silicone oil suffer from the inherent disadvantage that these materials are not always readily available, particularly at very remote well sites. Additionally, when using inert gas, there are inherent dangers due to the high pressures at which the inert gas must be initially placed within the tool while it is still above the ground and personnel are in the immediate vicinity of the tool.

SUMMARY OF THE INVENTION

The present invention provides a tool which provides both a trapped reference pressure and a trapped fluid spring, without the use of either a pressurized inert gas or of silicone oil.

The downhole tool of the present invention utilizes compressibility of the well fluid itself which is trapped in a relatively large compression chamber within the tool.

The downhole tool apparatus of the present invention includes a housing having a compression chamber defined therein with a fill passage means disposed through the housing for placing the compression chamber in open flow fluid communication with a well annulus exterior of the housing so that well fluid may flow into the compression chamber as the apparatus is lowered into a well.

An isolation valve means is provided for selectively closing the fill passage means and for thereby trapping the well fluid in the compression chamber.

An operating element is disposed in the housing. An actuating piston means is also slidably disposed in the housing and is operably associated with the operating element so that the operating element is operated in response to movement of the actuating piston means relative to the housing.

The actuating piston means and the housing are so arranged and constructed that movement of the actuating piston means between first and second positions thereof relative to the housing decreases a volume of the compression chamber and of any well fluid trapped therein. The volume of this compression chamber is sufficiently large that an equal volume of water containing no absorbed gases would have a volume decrease when subjected to a pressure increase equivalent to a predetermined operating pressure of the actuating piston means, at least as great as the decrease in volume of the compression chamber when the actuating piston is moved between its first and second positions relative to the housing.

Thus, the downhole tool apparatus of the present invention does not require the use of any inert gas or silicone oil, but still provides a tool having a trapped reference pressure and having a compressible fluid spring for aiding in return of the actuating piston to its original position.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 2 has been rotated 90° clockwise to aid in fitting the same on the sheet of drawings.

DETAILED DESCRIPTION OF THE PREFERRED EMBODIMENTS

Figure 1A:
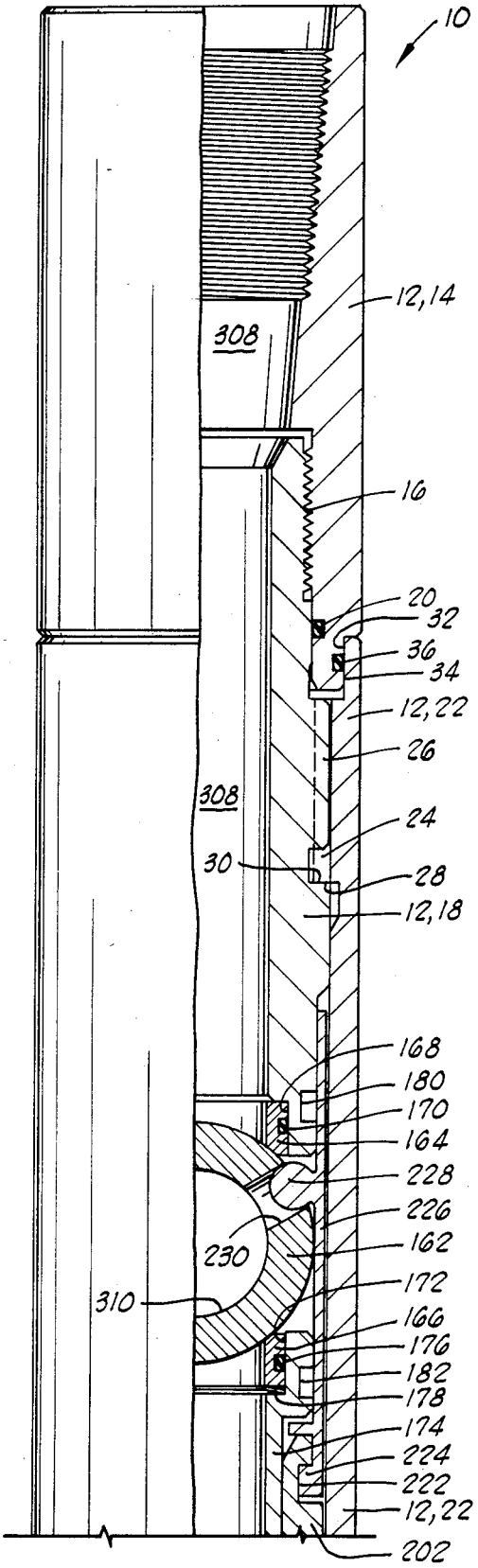
FIGS. 1A–1H comprise an elevation right side only sectioned view of the downhole apparatus of the present invention.
Figure 1B:
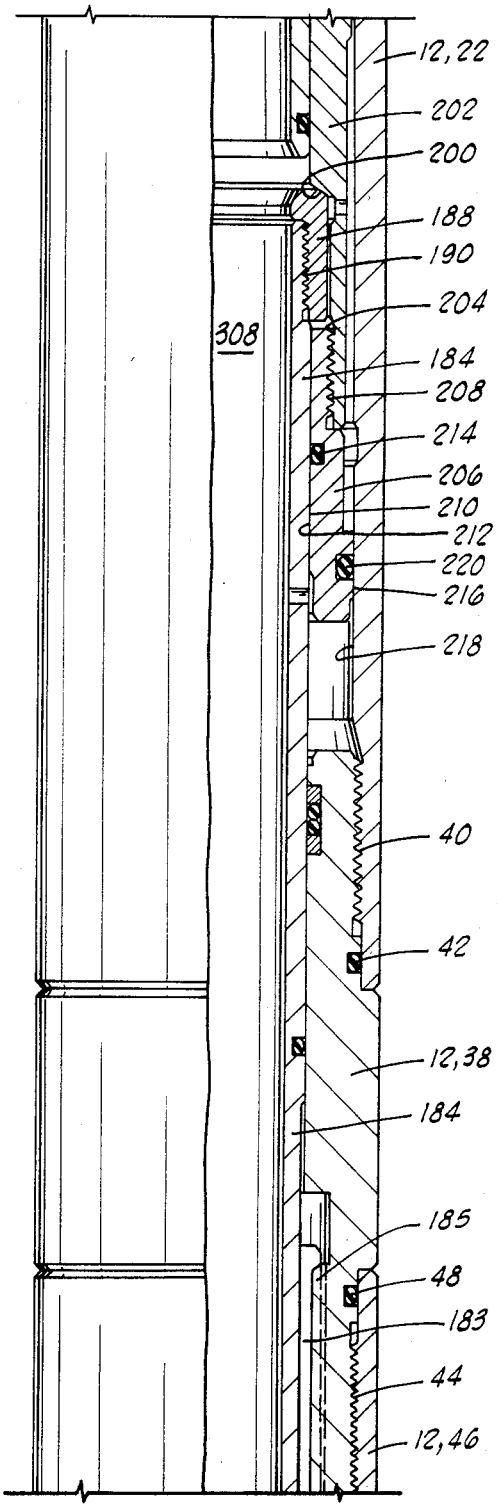

Referring now to the drawings, and particularly to FIGS. 1A–1H, the downhole tool apparatus of the present invention is shown and generally designated by the numeral 10. The downhole tool apparatus 10 may also be referred to as a well tester valve apparatus 10.

The apparatus 10 includes a housing generally designated by the numeral 12. The housing 12 includes a plurality of threadedly connected tubular members, the uppermost one of which is an upper adapter 14.

Threadedly connected at 16 to upper adapter 14 is an upper seat housing 18 of housing 12, with a seal being provided therebetween by resilient O-ring seal means 20.

Housing 12 includes a ball valve housing 22 which has a plurality of radially inward directed splines 24 which mesh with a plurality of radially outward directed splines 26 of upper seat housing 18.

Lower ends 28 of the splines 24 abut an upward facing annular shoulder 30 of upper seat housing 18 to hold the ball valve housing 22 longitudinally in place relative to the upper adapter 14 and the upper seat housing 18.

An upper inner cylindrical surface 32 of ball valve housing 22 is closely received about a cylindrical outer lower surface 34 of upper adapter 14 with a seal being provided therebetween by resilient O-ring seal means 36.

A first housing adapter 38 of housing 12 has its upper end threadedly connected at 40 to ball valve housing 22, with a seal being provided therebetween by resilient O-ring seal means 42. A lower end of first housing adapter 38 is threadedly connected at 44 to a spring chamber housing 46 of housing 12, with a seal being provided therebetween by resilient O-ring seal means 48.

A lower end of spring chamber housing 46 is threadedly connected at 48 to an air injection adapter 50 of housing 12 with a seal being provided therebetween by resilient O-ring seal means 52.

A lower end of air injection adapter 50 is threadedly connected at 54 to an outer lubricant chamber housing 56 of housing 12 with a seal being provided therebetween by resilient O-ring seal means 58.

Also, air injection adapter 50 has an upper inner lubricant chamber housing 60 of housing 12 threadedly connected to an internal thread 62 thereof with a seal being provided therebetween by resilient O-ring seal means 64.

Outer lubricant chamber housing 56 has a lubricant chamber adapter 66 of housing 12 threadedly connected thereto at 68 with a seal being provided therebetween by resilient O-ring seal means 70.

Upper inner lubricant chamber housing 60 has a lower inner lubricant chamber housing 72 threadedly connected thereto at 74 with a seal provided therebetween by resilient O-ring seal means 76.

Lubricant chamber adapter 66 has a first outer compression housing section 78 threadedly connected thereto at 80 with a seal being provided therebetween by resilient O-ring seal means 82.

The first outer compression housing section 78 includes an upper outer compression housing adapter 84 threadedly connected at 86 to an outer compression housing 88 which has its lower end threadedly connected at 90 to a lower outer compression housing adapter 92 of housing means 12.

The upper outer compression housing adapter 84 and the outer compression housing 88 of first outer compression housing section 78 are further connected by a circumferential weld 94. Also, outer compression housing 88 and lower outer compression housing adapter 92 of first outer compression housing section 78 are further connected by a circumferential weld 96 therebetween.

Thus, the upper outer compression housing adapter 84, the outer compression housing 88, and the lower outer compression housing adapter 92 are all permanently connected together by welds 94 and 96 to form the first outer compression housing section 78.

Concentrically received within the first outer compression housing section 78 of housing 12 is a first inner compression housing section 98 of housing 12.

The first inner compression housing section 98 includes an upper inner compression housing adapter 100 and an inner compression housing 102 threadedly connected together at 104 and further connected by a circumferential weld 106 therebetween.

A plurality of notches 105 are disposed in a lower outer edge of upper inner compression housing adapter 100 to allow fluid flow, through notches 105, between upper inner compression housing adapter 100 and an upward facing shoulder 107 of upper outer compression housing adapter 84.

Upper inner compression housing adapter 100 has an upper inner bore 108 within which is closely received an external cylindrical surface 110 of lower inner lubricant chamber housing 72 with a seal being provided therebetween by resilient O-ring seal means 112.

Housing 12 further includes a tube receiving adapter 114 threadedly connected to a lower end of lower outer compression housing adapter 92 at 116 with a seal being provided therebetween by resilient O-ring seal means 118. Tube receiving adapter 114 has an upper inner cylindrical bore 120 within which is closely received a cylindrical outer surface 122 of a lower end of inner compression housing 102 with a seal being provided therebetween by resilient O-ring seal means 124.

Figure 1C:
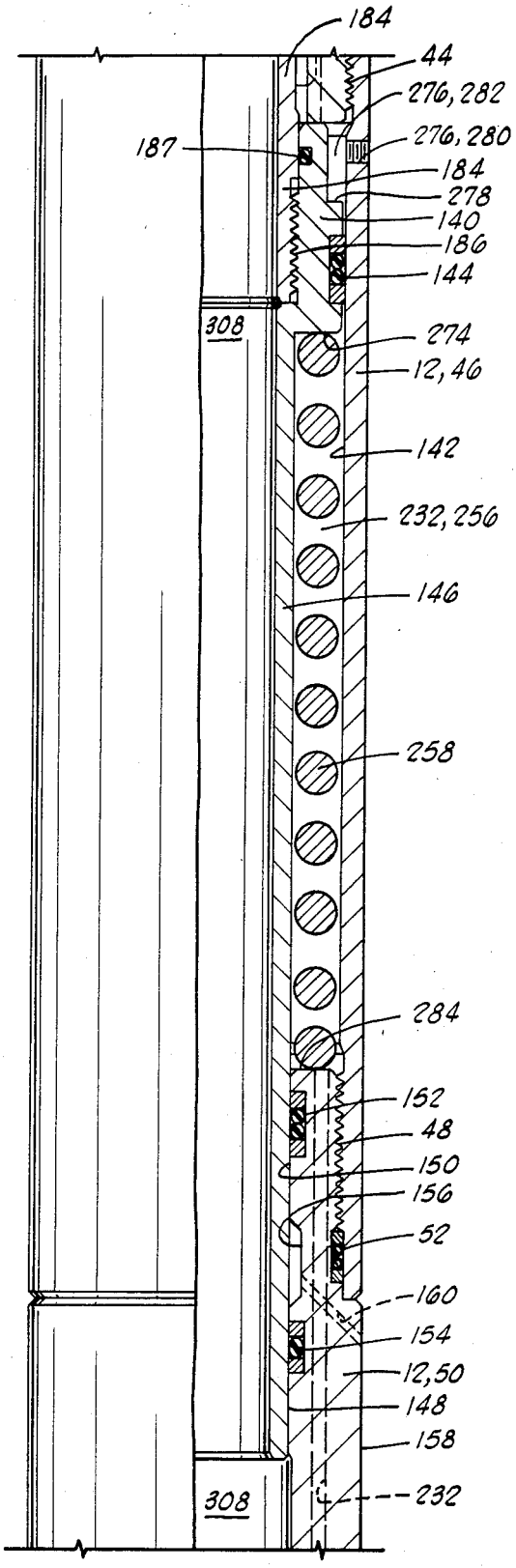
Figure 1D:
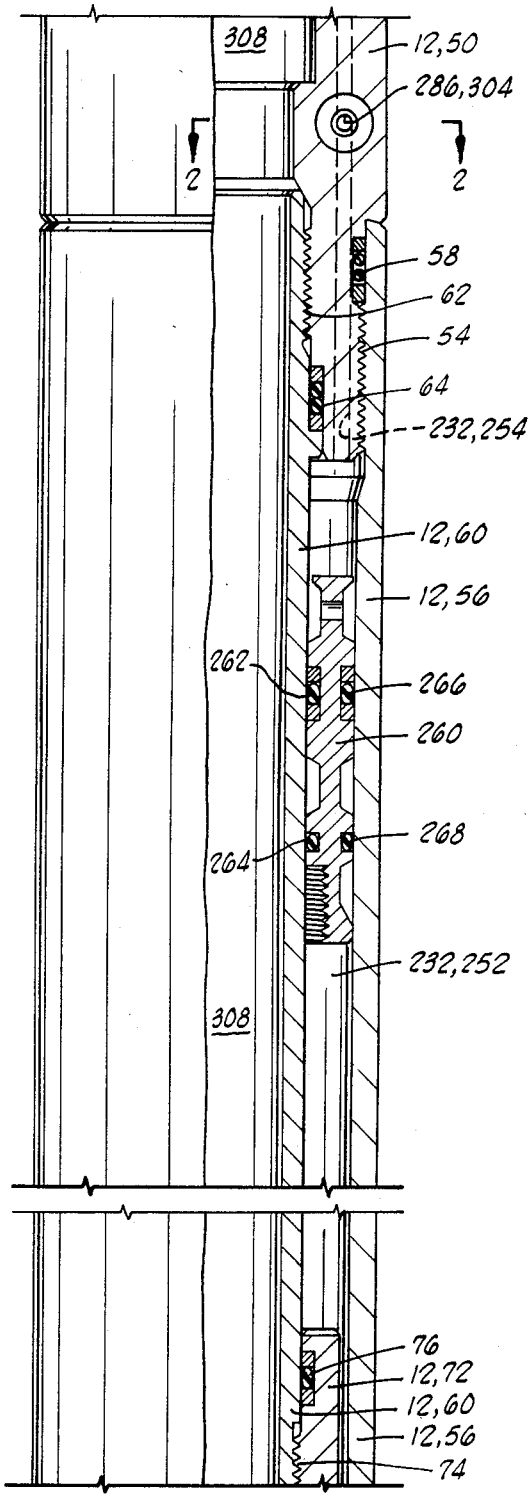
Figure 1E:
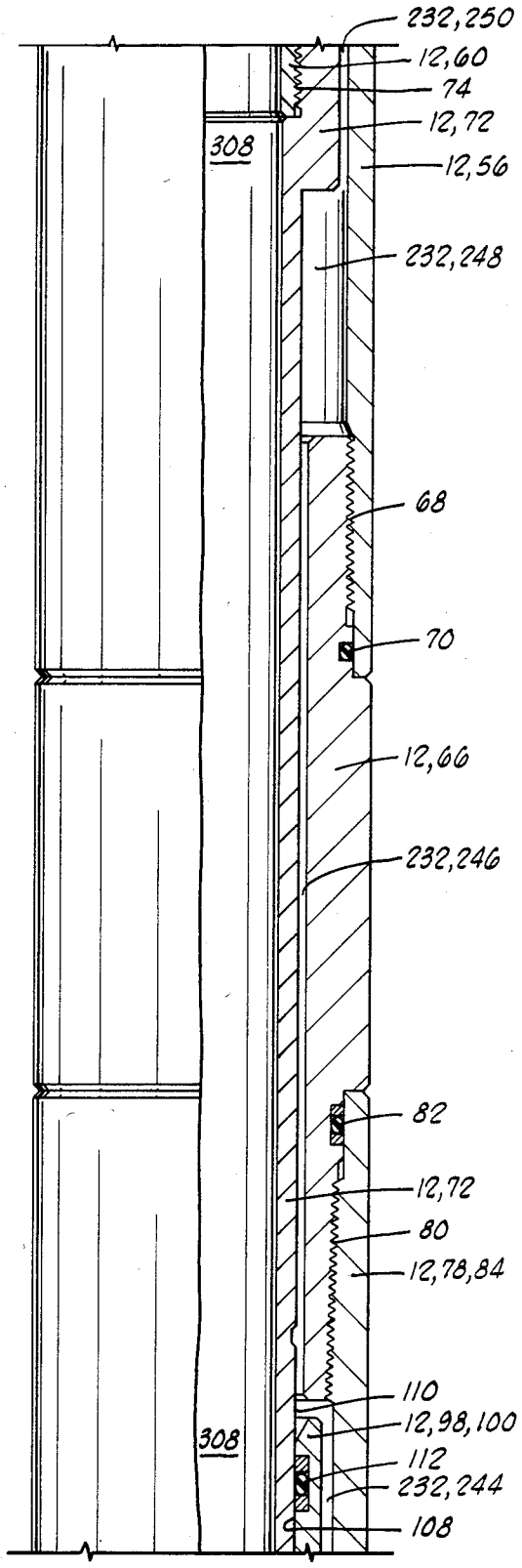
Figure 1F:
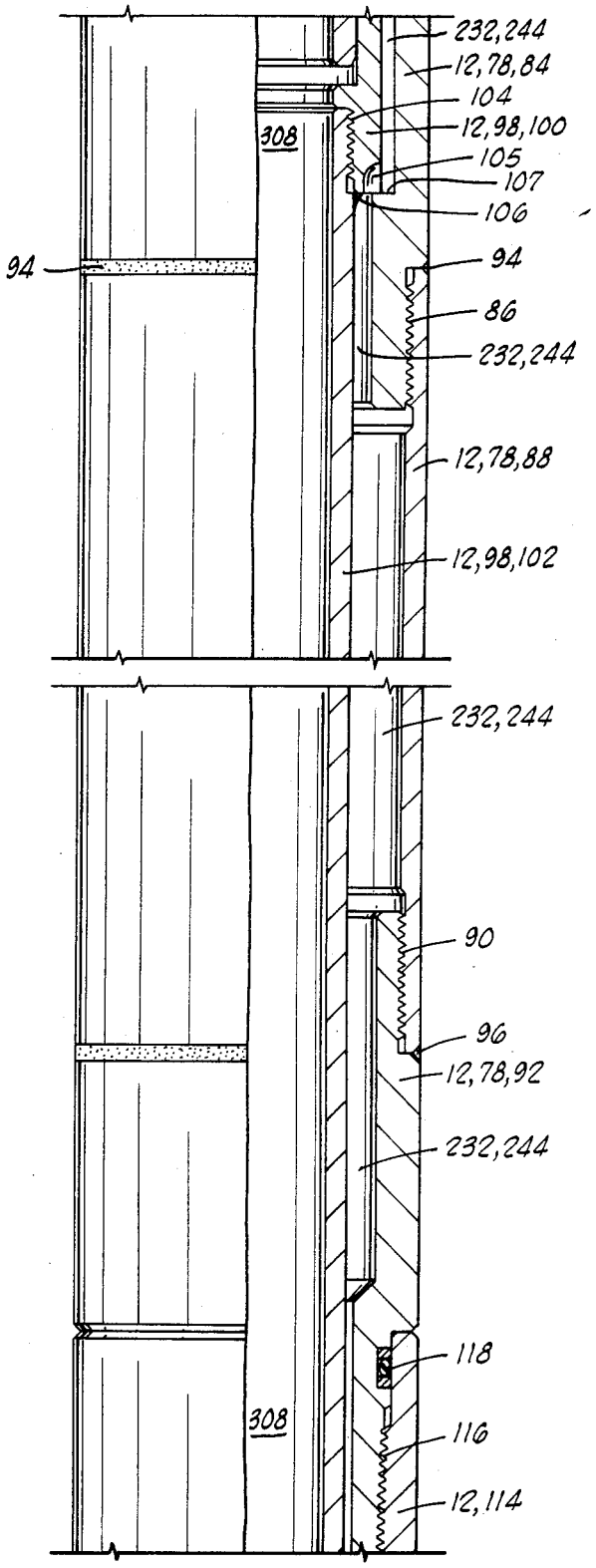
Figure 1G:
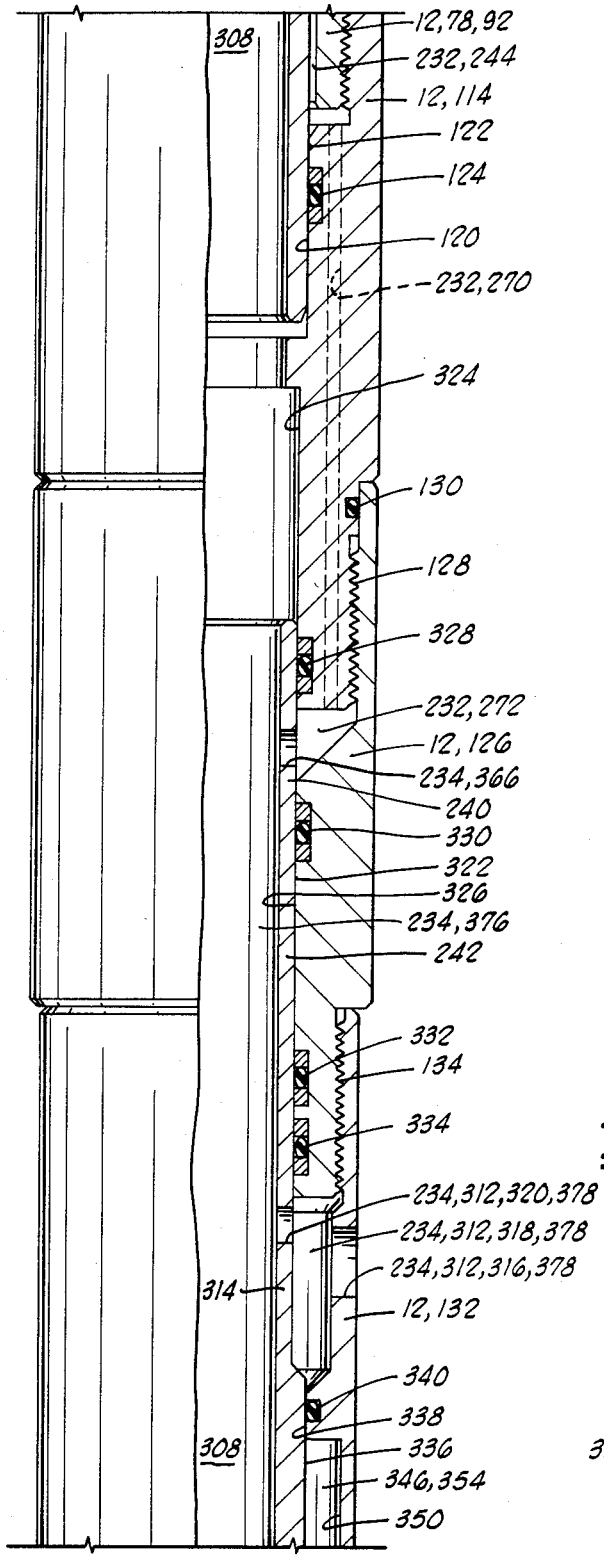
Figure 3:
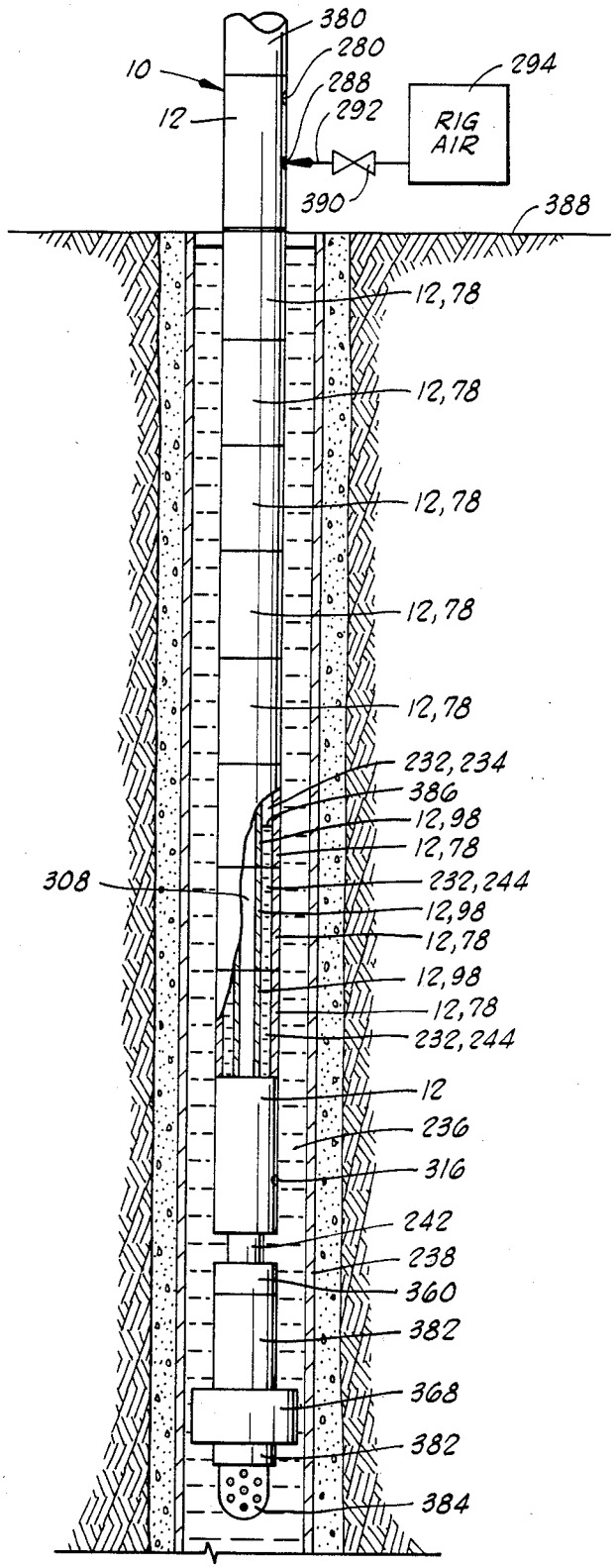
FIG. 3 is a schematic elevation view of the downhole tool apparatus of FIGS. 1A–1H showing the same partially lowered into place within a well.

In FIGS. 1E–1G, only a single outer compression housing section 78 and a single inner compression housing section 98 have been shown. Preferably, the outer and inner compression housing sections 78 and 98 each have a length of approximately ten feet. Preferably, the apparatus 10 includes a plurality of interconnected outer compression housing sections such as 78, and a complimentary plurality of interconnected inner compression housing sections 98, as is schematically illustrated in FIG. 3.

The manner in which this is accomplished will be readily apparent in view of the fact that the outside diameter of outer surface 122 of the inner compression housing 102 is the same as the outside diameter of outer surface 110 of lower inner lubricant chamber housing 72. Thus, a plurality of inner compression housing sections 98 may be interconnected merely by sliding the lower end of each of the inner compression housings such as 102 into the bore such as 108 of each of the upper inner compression housing adapters such as 100.

Similarly, additional outer compression housing sections 78 may be threadedly connected together since the internal threads at threaded connection 80 of upper outer compression housing adapter 84 are complimentary with the external threads at threaded connection 116 of the lower outer compression housing adapter 92.

The housing 12 also includes a valve adapter 126 connected to the lower end of tube receiving adapter 114 at threaded connection 128 with a seal being provided therebetween by resilient O-ring seal means 130.

A bypass housing 132 of housing 12 is connected to the lower end of valve adapter 126 at threaded connection 134.

A lower housing shoe 136 of housing 12 is connected to a lower end of bypass housing 132 at threaded connection 138.

An actuating piston means 140, which may also be referred to as a power piston means 140, is slidably disposed within a bore 142 of spring chamber housing 46 of housing 12 with a seal being provided therebetween by resilient O-ring piston seal 144.

In the embodiment illustrated in FIG. 1C, the actuating piston 140 is integrally formed on the upper end of a lower actuating mandrel 146.

The lower actuating mandrel 146 has a cylindrical outer surface 148 of a lower end thereof closely and slidably received within a bore 150 of air injection adapter 50 of housing 12, with a pair of seals being provided therebetween by resilient O-ring seal means 152 and 154.

An inner annular groove 156 is disposed in bore 150 of air injection adapter 50 and is communicated with an exterior surface 158 of air injection adapter 50 by an oblique port shown in dashed lines and designated by the numeral 160. The port 160 and annular groove 156 prevent any hydraulic blockage of movement of lower actuating mandrel 146 within the bore 150.

An operating element 162, which may also be described as a spherical full opening ball valve 162, is disposed within the housing 12 between upper and lower annular seats 164 and 166, respectively.

Upper seat 164 is received within a lower inner bore 168 of upper seat housing 18 with a seal being provided therebetween by resilient O-ring seal means 170.

Lower seat 166 is received within an upper inner bore 172 of a lower seat holder 174 with a seal being provided therebetween by resilient O-ring seal means 176. A single Belleville spring 178 biases lower seat 166 upward relative to lower seat holder 174.

Lower seat holder 174 is held in place relative to upper seat holder 118 by a plurality of C-clamps (not shown) which span grooves 180 and 182 in upper seat holder 18 and lower seat holder 174, respectively.

The actuating piston means 140 and the ball valve 162 are operably related so that the ball valve 162 is moved from its first closed position illustrated in FIG. 1A, corresponding to the first uppermost position of actuating piston 140 relative to housing 12 seen in FIG. 1C, by movement of actuating piston 140 downward to a second lower position corresponding to a second open position of ball valve 162. This is accomplished as follows.

The actuating piston means 140 is connected to an upper actuating mandrel 184 at threaded connection 186. A seal is provided therebetween by O-ring 187.

Upper actuating mandrel 184 includes a plurality of radially outward directed splines 183 which are interlocked with a plurality of radially inward directed splines 185 of first housing adapter 38 so as to permit relative longitudinal motion therebetween while preventing relative rotational motion therebetween.

Upper actuating mandrel 184 has a retaining collar 188 threadedly connected to the upper end thereof at threaded connection 190. Retaining collar 188 is longitudinally located between a downward facing shoulder 200 of an actuating sleeve 202 and an upper end 204 of an actuating collar 206. The actuating collar 206 and actuating sleeve 202 are connected together at threaded connection 208.

An upper external cylindrical surface 210 of upper actuating mandrel 184 is closely received within an inner bore 212 of actuating collar 206 with a seal being provided therebetween by resilient O-ring seal means 214.

An external cylindrical surface 216 of actuating collar 206 is closely and slidably received within a cylindrical inner surface 218 of ball valve housing 22 with a seal being provided therebetween by resilient O-ring sliding seal means 220.

The actuating sleeve 202 has a radially outer annular groove 222 disposed therein within which is received a radially inward directed flange 224 of a first actuating arm 226.

Actuating arm 226 has a lug 228 which is received within an eccentric radial bore 230 of spherical ball valve 162.

A second actuating arm (not shown) is similarly constructed and is peripherally spaced from the first actuating arm 226, so that longitudinal movement of actuating piston means 140 within the housing 12 is transmitted through the lugs such as 228 to the spherical ball valve member 162 to rotate the spherical ball valve member 162 from its closed first position to an open second position as the actuating piston 140 moves downward within the housing 12 from its initial position shown in FIG. 1C.

The housing 12 has an elongated compression chamber 232 defined therein. Housing 12 also has a fill passage means 234 disposed therethrough for placing the compression chamber 232 in open flow fluid communication with a well annulus 236 (see FIG. 3) exterior of the housing 12 so that well fluid may flow into the compression chamber 232 as the apparatus 10 is lowered into a well such as the one defined by casing 238 in FIG. 3.

By the term "open flow fluid communication" as used herein, it is meant that fluid can actually flow from one of the two designated points to the other. This is to be distinguished from the broader, more general terms such as "fluid communication" or "fluid pressure communication" used elsewhere herein which only require that fluid pressure can be transmitted between the two designated points, but do not require that it be possible for fluid to actually flow between the two designated points.

An isolation valve means 240 is defined on a valve sleeve 242 and provides a means for selectively closing the fill passage means 234 and for thereby trapping well fluid within the compression chamber 232.

The compression chamber 232 includes a main compression chamber portion 244 defined between the outer compression housing sections 78 and the inner compression housing sections 98.

When a plurality of outer compression housing sections 78 and a plurality of inner compression housing sections 98 are utilized as illustrated in FIG. 3, the main compression chamber portion 244 includes the annular space defined between all of the outer compression housing sections 78 and all of the inner compression housing sections 98. It will be appreciated in viewing FIGS. 1E–1G that the main compression chamber portion 244 can be described as a diametrically irregular annular space 244 located between the plurality of interconnected tubular outer housing sections 78 and the plurality of interconnected tubular inner housing sections 98.

Compression chamber 232 extends from the main compression chamber portion 244 upward through annular spaces 246, 248, and 250 to a lubricant chamber 252. Lubricant chamber 252 is communicated through a plurality of longitudinal passageways such as 254 disposed longitudinally through air injection adapter 50 with an annular spring chamber 256.

A coil compression spring 258 is disposed in spring chamber 256.

An annular floating piston 260 is disposed in lubricant chamber 252 and has a plurality of radially inner seals 262 and 264 which seal against upper inner lubricant chamber housing 60, and a plurality of outer seals 266 and 268 which seal against outer lubricant chamber housing 56.

The purpose of annular floating piston 260 is to permit spring chamber 256 to be filled with a non-corrosive fluid such as lubricating oil to protect the coil spring 258. The lubricating chamber 252 is filled with lubricating oil above annular piston 260, and will be filled with well fluid and/or possibly some entrapped air below the annular piston 260.

In the event that the coil compression spring 258 is eliminated or is constructed in such a manner that it can withstand the environment of the particular well fluid involved, the annular floating piston 260 may be eliminated.

The compression chamber 232 also extends downward from main compression chamber 244 through a plurality of longitudinal passageways 270 disposed through tube receiving adapter 114 to an annular cavity 272 defined between valve sleeve 242 and valve adapter 126.

The actuating piston means 140 is a differential area piston means 140 having its lower side 274 communicated with compression chamber 232. Lower side 274 may also be referred to as a first side or as a low pressure side of actuating piston means 140.

Housing 12 has a power passage means 276 disposed therethrough for communicating the well annulus 236 exterior of the housing 12 with an upper side 278 of actuating piston means 140. The upper side 278 of actuating piston means 140 may also be referred to as a second side or a high pressure side of actuating piston means 140.

The power passage means 278 includes a power port 280 and an annular cavity 282 defined between upper actuating mandrel 184 and spring chamber housing 46.

The actuating piston means 140 will move downward relative to housing 12 from its first position shown in FIG. 1C in response to increases in pressure in well annulus 236 relative to pressure within compression chamber 232 as is further described below.

The coil spring 258 previously mentioned can generally be described as a resilient mechanical spring biasing means 258 for biasing the actuating piston means 140 from its lower second position back toward its upper first position shown in FIG. 1C.

The coil compression spring 258 is disposed within spring chamber portion 256 of compression chamber 232 between the lower side 274 of actuating piston means 140 and an upper end 284 of air injection adapter 50.

As is further explained below with regard to the manner of operation of the present invention, it is sometimes desirable to inject a compressed gas into the compression chamber 232.

Figure 2:
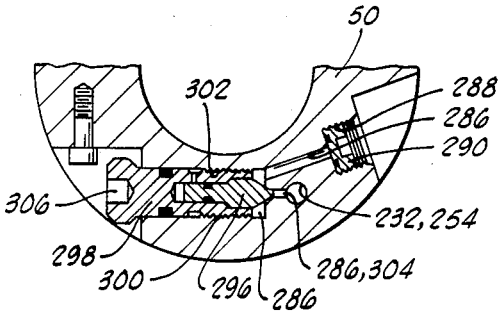
FIG. 2 is a sectional view taken along line 2—2 of FIG. 1D which shows an injection valve means.

This is accomplished through an air injection passage means 286 disposed through the housing 12 and best seen in FIG. 2.

FIG. 2 is a section view taken along line 2—2 of FIG. 1D and it illustrates the manner in which the air injection passage means 286 is communicated with longitudinal passageway 254 of compression chamber 232. FIG. 2 has been rotated 90° clockwise from the manner in which it would normally be shown in a section of FIG. 1D, in order to more easily fit the same on the sheet of drawings.

Air injection passage means 286 includes a threaded inlet 288, which is shown in FIG. 2 as being temporarily closed by a threaded plug 290.

As shown in FIG. 3, when it is desired to inject compressed air into the compression passage 232, an air line 292 from a source of rig air 294 is connected to threaded inlet 288 so as to communicate the source of rig air 294 with the air injection passage means 286.

A needle valve 296 is disposed in a valve carrier body 298 which itself is threadedly engaged at 300 with a threaded bore 302 of air injection adapter 50.

In FIG. 2, the needle valve 296 is shown in a closed position where it sealingly engages a short portion 304 of air injection passage means 286.

To open the air injection passage means 286 in order to permit air to flow from the source of rig air 294 into the compression passage 232, the valve carrier body 298 is rotated through use of a wrench inserted in socket 306 thereof so as to back off the threaded connection 300 and move needle valve 296 out of engagement with the short portion 304 of air injection passage means 286. The manner of use of air injection passage means 286 is further described below in the section headed "Alternative Manner Of Operation".

The housing 12 has a central flow passage 308 disposed therethrough. The ball valve member 162 is disposed within the flow passage 308 and, when in its closed position as illustrated in FIG. 1A, closes flow passage 308 to prevent fluid flow therethrough, and when in its second open position, has its ball valve bore 310 aligned with flow passage 308 to allow fluid flow through the flow passage 308.

The housing 12 has a bypass passage means 312 (see FIG. 1G) disposed therethrough for communicating the flow passage 308 of housing 12 with the well annulus 236 exterior of the housing 12.

The valve sleeve 242 includes a bypass valve portion 314 for selectively closing the bypass passage means 312.

The bypass passage means 312 includes a bypass port 316 disposed radially through bypass housing 132, an annular cavity 318 defined between valve sleeve 242 and bypass housing 132, and a bypass valve port 320 disposed through valve sleeve 242.

The valve sleeve 242 has an upper cylindrical outer surface 322 which is closely and slidingly received within a lower inner bore 324 of tube receiving adapter 114 and a bore 326 of valve adapter 126.

An O-ring seal 328 is disposed in a complimentary groove of bore 324 and provides a sliding seal between valve mandrel 242 and bore 324 above the annular cavity 272.

An O-ring seal 330 is disposed within a complimentary groove in bore 326 of valve adapter 126 and provides a sliding seal between valve mandrel 242 and bore 326 below annular cavity 272.

A pair of O-ring seals 332 and 334 are disposed in complimentary grooves in a lower portion of bore 326 of valve adapter 126 just above a lower end thereof.

The valve mandrel 242 further includes a lower enlarged outer diameter cylindrical surface 336 which is closely slidably received within a reduced inner diameter bore 338 of bypass housing 132 with a sliding seal being provided therebetween by resilient O-ring seal means 340. Cylindrical outer surface 336 is also closely slidingly received within a bore 342 of lower housing shoe 136 with a sliding seal being provided therebetween by resilient O-ring seal means 344.

A metering chamber 346 is defined between cylindrical outer surface 336 on the inside and bypass housing 132 and lower housing shoe 136 on the outside, with its upper and lower extremities being defined by seals 340 and 344, respectively.

A metering piston 348 is disposed on valve mandrel 242 and is closely slidingly received within an inner bore 350 of bypass housing 132 with a seal being provided therebetween by resilient O-ring piston seal 352.

The metering piston 348 divides metering chamber 346 into an upper portion 354 and a lower portion 356.

Metering chamber 346 is filled with a suitable fluid such as oil. Metering piston 348 has a fluid flow restricting orifice 358 disposed therethrough communicating upper and lower portions 354 and 356 of metering chamber 346.

The metering piston 348 with its orifice 358 therethrough impedes movement of valve mandrel 242 relative to housing 12. For valve mandrel 242 to move relative to housing 12, the metering fluid contained in metering chamber 346 must flow through orifice 358 between upper and lower metering chamber portions 354 and 356.

Figure 1H:
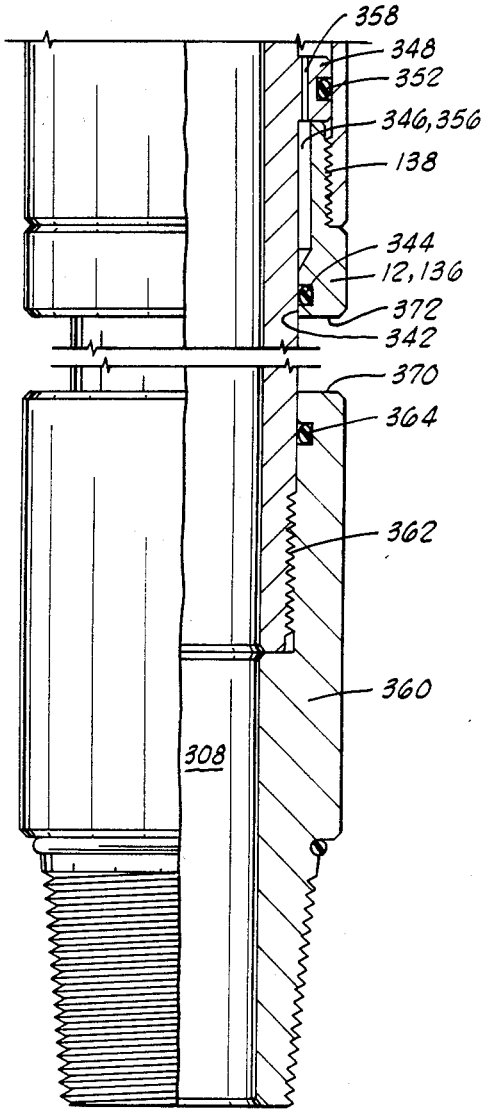

The metering piston 348 and associated structure are shown only in a schematic fashion in FIGS. 1G and 1H.

The lower end of valve mandrel 242 has a lower adapter 360 connected thereto at threaded connection 362 with a seal being provided therebetween resilient O-ring seal means 364.

As previously mentioned, the valve mandrel 242 has the bypass valve port 320 disposed therethrough. Valve mandrel 242 also has an isolation port 366 disposed therethrough communicating the flow passage 308 with annular cavity 272 of compression chamber 232. The isolation port 232 may also be considered to be a portion of the fill passage means 234.

The valve mandrel 242 is shown in FIGS. 1G–1H in the position which it is in when apparatus 10 is run into a well. The isolation port 366 is located below seal 328 and provides open communication between the flow passage 308 and the compression chamber 232.

Also, the bypass valve port 320 is located below seal 334 and provides open communication between flow passage 308 and annular cavity 318 and bypass port 316.

After the apparatus 10 is lowered to its desired location within a well, weight is set down on the apparatus 10 to set a packer means 368 (see FIG. 3) located therebelow, and to close the isolation valve means 240 and the bypass valve means 314.

When weight is set down on the apparatus 10 for a sufficient period of time determined by the construction of the metering piston 348 and its orifice 358, the housing 12 moves longitudinally downward relative to valve mandrel 242 until an upper end 370 of lower adapter 360 abuts a lower end 372 of lower housing shoe 136. When the ends 370 and 372 abut, the valve mandrel 242 is in a position relative to housing 12 such that isolation port 366 is located above seal 328 and bypass valve port 320 is located above seal 334.

Thus, the isolation valve means 240 and the bypass valve means 314 are operatively associated so that they are both open at the same time and are both closed at the same time.

The fill passage means 234 can be further described as including a first portion 376 which is coincident with a portion of flow passage 308.

Fill passage means 234 further includes a second portion 378 which is coincident with bypass passage means 312 and thus communicates flow passage 308 with the well annulus 236.

The isolation valve means 240 can be described as being located between the compression chamber 232 and first portion 376 of fill passage means 234, and the bypass valve means 314 may be described as being located between the first and second portions 376 and 378 of fill passage means 234.

The apparatus 10 is constructed so that the compression chamber 232 has a total volume sufficiently large that an equal volume of water containing no absorbed gases would have a volume decrease when subjected to a pressure increase equivalent to a predetermined operating pressure of the actuating piston means 140, at least as great as the decrease in volume of the compression chamber 232 when the actuating piston means 140 is moved between its first and second positions relative to the housing 12.

The majority of this volume of the compression chamber 232 is defined within the main compression chamber portion 244 located between the outer compression housing sections 78 and the inner compression housing sections 98.

The actual total volume required for the compression chamber 230 will depend upon a number of parameters.

First, the volume change which the compression chamber 232 must undergo when it is compressed, is equal to the displacement of actuating piston means 140 as it moves from its first upper position illustrated in FIG. 1C to a lower second position corresponding to an open position of ball valve member 162. This displacement is equal to the annular area of acutating piston 140 defined between seals 144 and 152, multiplied by the longitudinal displacement of actuating piston means 140 as it moves downward between its first and second positions.

The required total volume for compression chamber 232 to accommodate that displacement of actuating piston means 140 depends upon a number of parameters.

First, it is dependent upon the particular well fluid which will be involved, and particularly it is dependent upon the compressibility factor of that well fluid. Generally, the well fluid involved will be drilling mud, which normally has a compressibility factor at least as great as that of water which has no absorbed gases contained therein.

Thus, the compression chamber 232 of the apparatus 10 of the present invention is designed based on the assumption that the well fluid will have a compressibility factor equal to that of water with no absorbed gases under the appropriate conditions.

Those appropriate conditions which also must be taken into consideration include the operating temperature of the well at the particular depth involved, the hydrostatic pressure within the well annulus 236 at the depth at which it is desired to operate the apparatus 10, and the operating pressure which permissibly can be applied across the actuating piston means 140.

The operating temperature and the hydrostatic pressure are of course determined by the particular location in the well where it is necessary to utilize the apparatus 10, and thus they are fixed parameters in a given well situation.

The operating pressure which can permissibly be applied across actuating piston means 140 depends upon the maximum pressure increase which permissibly can be applied to the well annulus 236.

It is contemplated with the apparatus 10 of the present invention that it will normally be designed for an operating pressure in the range of about 1500 to 2000 psi. That is, the well annulus 236 will be pressurized to a pressure 1500 to 2000 psi greater than the hydrostatic pressure normally present within the annulus.

This permissible operating pressure is based upon the strength of the well casing and the tubular members connected to the tubing string lowered into the well casing. It must be sufficiently low that it does not rupture the well casing or collapse the tubular members immersed within the well.

Thus, given the desired operating pressure of 1500 to 2000 psi which will be applied downwardly across the actuating piston 140, and given the compressibility factor for water with no absorbed gases at the operating temperature and initial hydrostatic pressure of the well annulus 236, the required volume of compression chamber 232 can be calculated.

As an example of the appropriate volume of compression chamber 232 for a given displacement of actuating piston means 140, one particular design for the apparatus 10 involves an actuating piston displacement of 14.68 cubic inches when the actuating piston moves between its first and second positions. For that displacement, the compression chamber 232 must have a volume of at least 8,500 cubic inches using a compressibility factor of 0.004 $\Delta V/V$ for water at room temperature and where $\Delta V/V$ is expressed in percent (%) for each atmosphere of change in pressure at or around a pressure of 250 atmospheres.

With that particular ratio of displacement to compression chamber volume, the apparatus 10 can operate in most commonly encountered well environments.

In actual practice, the provision of a compression chamber having a volume determined as described above, will provide a significant margin of safety. This is because the chamber 232 will always contain some amount of air which is trapped therein during assembly of the apparatus 10, and additionally, the drilling mud normally used as well fluid will have a significant amount of gas therein. Both of these sources of trapped gas provide additional compressibility of the total volume of fluid which is contained within the compression chamber 232.

NORMAL MANNER OF OPERATION

The typical manner of operation of the apparatus 10 will now be described.

The apparatus 10 is assembled and initially oriented in the manner shown in FIGS. 1A–1H.

During the initial assembly of apparatus 10, the compression chamber 232 is communicated with the surrounding ambient air at the surface 388 of the well through the fill passage means 234, and thus the compression chamber 232 will initially be filled with air at the atmospheric pressure and ambient temperature prevailing at the surface location 388 of the well.

The upper adapter 14 of housing 12 is threadedly connected to a tubing string 380 as shown in FIG. 3.

The lower adapter 360 is threadedly connected to a packer housing 382 of the packer means 368.

A perforated tail pipe 384 is connected to the lower end of the packer housing 382.

The tubing string 380 with the apparatus 10 and other apparatus just described attached as shown in FIG. 3 is lowered into the well defined by well casing 238.

It is noted that FIG. 3 illustrates the apparatus 10 connected to the tubing string 380, after the apparatus 10 has been partially lowered into the well defined by well casing 238. Those portions of FIG. 3 near the upper end thereof relating to the rig air source 294 and rig air supply line 292 are not utilized in the normal operation of the apparatus 10, and thus they may be ignored for the purposes of the present description of this normal operation.

The apparatus 10 is lowered on the tubing string 380 into the well 238 to a desired location. Normally this location will be such that the packer means 368 is located immediately above a subsurface formation (not shown) intersecting the well 238, so that the packer 368 may be set to allow the subsurface formation to be tested through the tubing string 380 or to allow treatment fluids to be pumped down the tubing string 380 into the subsurface formation located immediately below the packer means 368.

As the apparatus 10 is lowered on the tubing string 380 into the well, open flow fluid communication is provided through fill passage means 234 between the compression chamber 232 and the well annulus 236. Thus, well fluid flows from the well annulus 236 through the fill passage means 234 into the compression chamber 232 as the apparatus 10 is lowered into the well.

During this lowering process, the pressure of the well fluid at a given elevation within the compression chamber 232 will be substantially equal to the hydrostatic pressure of well fluid in well annulus 236 at that same elevation.

The well fluid entering compression chamber 232 will contact the air already present in compression chamber 232 at an air-well fluid interface 386. As well-air fluid interface 386 moves upward through the compression chamber 232 as the apparatus 10 is lowered deeper into the well 238, the air initially present within the compression chamber 232 will be compressed into a relatively small volume located above air-well fluid interface 386.

As the air-well fluid interface 386 moves upward through the main compression chamber portion 244, which may also be referred to as a diametrically irregular annular space 244, the air-well fluid interface 386 moves past a number of upset diameters on both the inner surfaces of the outer compression housing sections 78 and the outer surfaces of the inner compression housing sections 98.

The pressure of the air trapped within compression chamber 232 above the air-well fluid interface 386 will be equal to the hydrostatic pressure of the well fluid within well annulus 236 at the elevation of the air-well fluid interface 386.

Since there is only a relatively small mass of air trapped within the compression chamber 232, which is equal to the mass of air required to fill the chamber 232 at atmospheric pressure and ambient temperature, that air will be compressed to a negligible, very small volume when the apparatus 10 is located at conventional depths on the order of many thousands or perhaps tens of thousands of feet within a well, and thus the compression chamber 232 is usually substantially completely filled with well fluid by the time the apparatus 10 has been completely lowered to its desired final location within the well 238.

Once the apparatus 10 is at its desired location within the well 238, the tubing string 380 is manipulated to set the packer means 368 so that it seals against the casing 238 thus anchoring the tubing string 380 and the apparatus 10 relative to the casing 238. A preferred tool for use as the packer means 368 is a packer made by Halliburton Services Division of Halliburton Company, the assignee of the present invention, and referred to as a "Retrievable Test-Treat-Squeeze Packer" as shown at pages 4014–4015 of Halliburton Services Sales and Service Catalog, No. 41. This particular packer is set by setting down weight on the packer and applying right-hand torque to the tool string 380.

As part of this manipulation, or thereafter, weight is slacked off on tubing string 380 for a sufficient period of time to allow the housing 12 to move downward relative to valve mandrel 242 thus closing the bypass passage means 312 and also closing the fill passage means 234 thus trapping well fluid within the compression chamber 232.

This trapped well fluid will initially be at a pressure equal to the hydrostatic pressure within the well annulus 236 at the same elevation at the time the fluid was trapped.

Then, fluid pressure is increased within the well annulus 232 by a pump (not shown) located at the surface and communicated with the annulus 236 in a manner well known to those skilled in the art. This increased well annulus pressure is communicated through the power port 280 of power passage means 276 to the upper side 278 of actuating piston means 140, thus creating a downward pressure differential across actuating piston means 140.

As previously mentioned, it is contemplated that the apparatus 10 will typically be designed for an operating pressure of approximately 1500 to 2000 psi.

This downward pressure differential of approximately 1500 to 2000 psi causes the actuating piston means 140 to move downward relative to housing 12, thus moving the ball valve member 162 to its open position and allowing fluid to flow from the subsurface formation upward through the perforated tail pipe 384, the central bore (not shown) of packer housing 382, the flow passage 308 of apparatus 10, and the tubing bore (not shown) of tubing string 380.

As the actuating piston means 140 moves downward relative to housing 12, the well fluid trapped within compression chamber 232 is compressed and a volume thereof is decreased.

In those situations where the compression chamber 232 is substantially completely filled with well fluid, a first amount by which the volume of the trapped well fluid is decreased is approximately equal to a second amount by which the entire volume of the compression chamber 232 is decreased. This second amount is of course equal to the displacement of the actuating piston means 140.

When utilizing the apparatus 10 in the manner just described wherein the only gas originally present in the compression chamber 232 is air at atmospheric pressure and temperature, and when using the apparatus at typical depths within a well, the mass of air present within the compression chamber 232 is so small that it contributes very little to the volume compression required to accommodate the displacement of actuating piston 140. That is, the volume change which occurs within the compression chamber 232 must primarily be accounted for by a decrease in volume in the well fluid contained within compression chamber 232, and only a relatively small amount of that volume decrease is accommodated by compression of the air which might be trapped in the compression chamber 232. This is because the amount of air is so small that it has already been compressed to a very small volume as the apparatus 10 is lowered into the well.

Thus, it can generally be stated that when the apparatus 10 is operated in its normal manner just described above, and when the actuating piston means 140 moves between its first and second positions, the volume of the well fluid trapped within the compression chamber 232 changes by an amount greater than one-half of the amount by which the total volume of the compression chamber changes. Thus, the apparatus 10, when used in the manner just described, relies primarily upon the compressibility of the well fluid to accommodate the displacement of the actuating piston 140. A majority of the total amount of fluid pressure energy which is stored within the various fluids trapped in the compression chamber is thus stored by compression of the trapped well fluid.

After the well testing procedure or well treatment procedure is completed, the increased well pressure previously applied to well annulus 236 is released so that the well annulus 236 returns to hydrostatic pressure. This eliminates the downward pressure differential across actuating piston means 140, and the trapped fluids, particularly the trapped well fluid, within compression chamber 232 expand thus forcing the actuating piston 140 back up to its initial position as shown in FIG. 1C corresponding to the closed position of ball valve means 140 as seen in FIG. 1A.

This upward movement of actuating piston means 140 is aided by the coil compression spring 258. Preferably, the coil compression spring 258 is sufficiently sized so that in most situations it could return the actuating piston means 140 to its first position thus closing the ball valve 162 even in the absence of the upward force from the compressed fluid within compression chamber 232.

Then, through appropriate manipulation of the tubing 380, the packer means 368 is released from its engagement with the well casing 238 and the apparatus 10 may be removed from the well or moved to another location within the well.

Also, during this manipulation of the tubing string 380, the housing 12 of apparatus 10 is returned to its upward position relative to valve mandrel 242 so that the fill passage means 234 and bypass passage means 312 are both again opened.

ALTERNATIVE MANNER OF OPERATION

There is also an alternative manner in which the apparatus 10 of the present invention may be utilized when it is desired to lower the operating pressure which must be applied to the well annulus 236 to operate the apparatus 10.

This is best understood with reference to FIGS. 2 and 3.

The apparatus 10 as shown in FIG. 3 after it has been partially lowered into the well 238 to an intermediate position wherein a lower portion of the apparatus 10 is within the well 238 and is immersed in well fluid as seen in FIG. 3, and an upper portion of the apparatus 10 still extends above a ground surface 88 at the well location.

First, it should be noted that when utilizing the apparatus 10 in its second mode, wherein pressurized air is to be injected into the compression chamber 232, the annular floating piston 260 within the lubricating chamber 252 will generally be eliminated, and thus there will be no lubricating fluid within the lubricating chamber 252 or the spring chamber 256.

Then, the rig air system 294, which is a source of compressed air normally at a pressure in the range of 100 to 140 p si, is connected through the rig air line 292 to the inlet 288 of air injection passage means 286.

Then, the needle valve 296 is opened and a valve 390 in the rig air line 292 is opened so that the compressed air from the rig air source 294 is communicated with the longitudinal passageway 254 of compression chamber 232.

Remembering that the fill passage means 234 is open, it will be understood that prior to connection of the rig air source 294 to the compression chamber 232, well fluid will have risen into the compression chamber 232 so that the air-well fluid interface 386 is at some intermediate location as shown in FIG. 3.

Once the compressed air from the rig air source 294 at a pressure in the range of 100 to 140 psi is applied to the compression chamber 232, however, all of the well fluid then present within the compression chamber 232 will be forced downward out through the fill passage means 234 and back to the well annulus 236 or at least into the flow passage 308.

Thus, the compressed air which remains within the compression passage 232 when the apparatus 10 is located as shown in FIG. 3 and the rig air source 294 has been communicated with the compression passage 232 will be at an initial pressure substantially equal to a hydrostatic pressure of well fluid within the well annulus 236 at the elevation of a lower end of the compression chamber 232, which in the embodiment illustrated in FIGS. 1A–1H is the elevation of isolation port 366. For an apparatus 10 as shown in FIG. 3 having eight stacked outer compression housing sections 78, each ten feet long, the initial air pressure in chamber 232 will be approximately 50 psi.

After the compression chamber 232 has been filled with air, the needle valve 296 is closed and the rig air line 292 is removed.

Then the apparatus 10 may be further lowered into the well to its final desired location.

Using this alternative manner of operation of the apparatus 10, wherein the compression chamber 232 is filled with compressed air from the rig air source 294, a sufficient mass of air is present within the compression chamber 232 such that in many operating situations the displacement of actuating piston means 140 will be accommodated primarily by compression of the air rather than compression of the trapped well fluid.

The injection of such a mass of compressed air into compression chamber 232 will lower the required operating pressure which must be applied to well annulus 236 to about 1000 psi, as compared to the 1500 to 2000 psi previously mentioned for the normal manner of operation of apparatus 10 where no air is injected.

Thus it is seen that the apparatus and methods of the present invention readily achieve the ends and advantages mentioned as well as those inherent therein. While certain perferred embodiments have been described for the purposes of the present disclosure, numerous changes in the arrangement and construction of parts and steps may be made by those skilled in the art, which changes are encompassed within the scope and spirit of the present invention as defined by the appended claims.

What is claimed is:

1. A downhole tool apparatus, comprising:

a housing, having a compression chamber defined therein, and having a fill passage means disposed through said housing for placing said compression chamber in open flow fluid communication with a well annulus exterior of said housing so that well fluid may flow into said compression chamber as said apparatus is lowered into a well;

an isolation valve means for selectively closing said fill passage means and for thereby trapping said well fluid in said compression chamber;

an operating element disposed in said housing;

an actuating piston means slidably disposed in said housing, said actuating piston means being operably associated with said operating element so that said operating element is operated in response to movement of said actuating piston means relative to said housing;

a bypass passage means disposed through said housing for communicating a flow passage of said housing with said well annulus exterior of said housing;

a bypass valve means for selectively closing said bypass passage means;

wherein said actuating piston means and said housing are so arranged and constructed that movement of said actuating piston means between first and second positions thereof relative to said housing decreases a volume of said compression chamber and of any well fluid trapped therein; and wherein said volume of said compression chamber is sufficiently large that an equal volume of water containing no absorbed gases would have a volume decrease when subjected to a pressure increase equivalent to a predetermined operating pressure of said actuating piston means, at least as great as the decrease in volume of said compression chamber when said actuating piston means is moved between its first and second positions relative to said housing.

2. The apparatus of claim 1, further comprising:

resilient mechanical spring biasing means for biasing said actuating piston means from its said second position back toward its said first position.

3. The apparatus of claim 2, wherein:

said resilient mechanical spring biasing means is disposed in said compression chamber.

4. The apparatus of claim 3, further comprising:

an annular floating piston disposed in said compression chamber and dividing said compression chamber into first and second chamber portions;

wherein said resilient mechanical spring biasing means is disposed in said first chamber portion;

wherein said first chamber portion is filled with a relatively non-corrosive fluid and is isolated from open flow fluid communication with said second chamber portion by said floating piston; and wherein said fill passage means communicates said second chamber portion with said well annulus exterior of said housing.

5. The apparatus of claim 1, further comprising:

means for injecting air into said compression chamber as said apparatus is lowered from a drilling rig into said well.

6. The apparatus of claim 1, wherein:

a majority of said volume of said compression chamber is defined by a plurality of interconnected tubular outer housing sections and by a plurality of interconnected tubular inner housing sections, said majority of said volume of said compression chamber being a diametrically irregular annular space between said plurality of interconnected tubular outer housing sections and said plurality of interconnected tubular inner housing sections.

7. The apparatus of claim 1, wherein:

said isolation valve means and said bypass valve means are operatively associated so that they are both open at the same time and are both closed at the same time.

8. The apparatus of claim 1, wherein:

a first portion of said fill passage means is coincident with a portion of said flow passage;

a second portion of said fill passage means is coincident with said bypass passage means;

said isolation valve means is between said compression chamber and said first portion of said fill passage means; and said bypass valve means is between said first and second portions of said fill passage means.

9. The apparatus of claim 8, wherein:

said isolation valve means and said bypass valve means are both sleeve-type valves operated by a single common valve mandrel sleeve slidably disposed in said housing; and said isolation valve means and said bypass valve means are both adapted to be operated by vertical reciprocation of a tubing string attached to said apparatus.

10. The apparatus of claim 1, wherein:

said apparatus is a tester valve; and said operating element is a flow valve disposed in a flow passage of said housing to selectively open and close said flow passage.

11. The apparatus of claim 1, wherein:

said actuating piston means is a differential area piston means having a first side thereof communicated with said compression chamber; and said housing has a power passage means disposed therethrough for communicating said well annulus exterior of said housing with a second side of said actuating piston means, so that said actuating piston means moves between its said first and second positions relative to said housing in response to changes in well annulus pressure external of said housing.

* * * * *